US008262420B2

(12) United States Patent
Xiong et al.

(10) Patent No.: US 8,262,420 B2
(45) Date of Patent: Sep. 11, 2012

(54) ELECTRICAL CONNECTOR WITH A STABLE STRUCTURE

(75) Inventors: Feng Xiong, Kunshan (CN); Zi-Qiang Zhu, Kunshan (CN); Lun-Song Hu, Kunshan (CN); Hong-Qiang Han, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 190 days.

(21) Appl. No.: 12/859,430

(22) Filed: Aug. 19, 2010

(65) Prior Publication Data

US 2011/0045709 A1 Feb. 24, 2011

(51) Int. Cl.
*H01R 13/648* (2006.01)

(52) U.S. Cl. ..... 439/701; 439/607.23

(58) Field of Classification Search ..... 439/701, 439/660, 607.13, 607.23, 607.35, 607.39, 439/609.4, 351–353
See application file for complete search history.

(56) References Cited

U.S. PATENT DOCUMENTS

| | | | | |
|---|---|---|---|---|
| 6,106,338 | A * | 8/2000 | Wu et al. | 439/660 |
| 7,632,111 | B2 * | 12/2009 | Xiong et al. | 439/79 |
| 7,748,994 | B1 * | 7/2010 | Peng et al. | 439/74 |
| 7,931,497 | B2 * | 4/2011 | Yang et al. | 439/567 |
| 8,070,517 | B2 * | 12/2011 | Xiong et al. | 439/607.28 |
| 8,075,345 | B2 * | 12/2011 | Peng | 439/660 |

FOREIGN PATENT DOCUMENTS

| | | |
|---|---|---|
| TW | M273098 | 8/2005 |

* cited by examiner

*Primary Examiner* — Xuong Chung Trans
(74) *Attorney, Agent, or Firm* — Wei Te Chung; Andrew C. Cheng; Ming Chieh Chang

(57) ABSTRACT

An electrical connector (100) includes a first housing (1) and a second housing (3) retained to the first housing (1). The first housing (1) has a mating surface (11) and a mounting surface (12) at two sides thereof. The second housing (3) has a joint surface (31) to joint with the mounting surface (12). The first housing (1) defines a locking slot (131) recessed from the mounting surface (12). The second housing (3) is formed with a pair of spring arms (34) extending out of the joint surface (31) to resist opposed two inner walls of the locking slot (131).

14 Claims, 5 Drawing Sheets

ELECTRICAL CONNECTOR WITH A STABLE STRUCTURE

BACKGROUND OF THE INVENTION

1. Field of the Invention

The present invention relates to electrical connectors, more particularly to an electrical connector with a stable structure.

2. Description of Related Art

Electrical connectors are widely used in electronic device. An electrical connector usually includes an insulative housing, a number of contacts retained in the insulative housing and a spacer retained on the insulative housing for positioning the contacts. The insulative housing has a pair of side walls and a cavity between the side walls for receiving the spacer. Each side wall defines a position slot extending along a front to back direction at an inner side thereof. The position slots communicate with the cavity. The spacer defines a plurality of through holes for receiving a tail portion of the contacts. Besides, the spacer is formed with a pair of blocks at two sides thereof to lock with the position slots of the side walls for positioning the spacer to the insulative housing.

However, the manufacture of the position slots and blocks needs a high precision for stably positioning the spacer to the insulative housing. If the blocks are made too big, the blocks can not be easily assembled to the position slots; while if the blocks are made too small, the blocks can not be stably positioned in the position slots, and easily depart from the position slots, then the spacer can not stably position the contacts.

Hence, an improved electrical connector is desired to overcome the above problems.

BRIEF SUMMARY OF THE INVENTION

According to one aspect of the present invention, an electrical connector comprises: a first housing having a mating surface and a mounting surface at two sides thereof; and a second housing having a joint surface to joint with the mounting surface; wherein the first housing defines a locking slot recessed from the mounting surface, and the second housing is formed with a pair of spring arms extending out of the joint surface to resist opposed two inner walls of the locking slot.

According to another aspect of the present invention, a method of making an electrical connector, comprises: a first housing having a mating surface and a mounting surface at two sides thereof; and a second housing retained to the first housing and having a joint surface to joint with the mounting surface; wherein the first housing defines a locking slot and a position slot respectively recessed from the mounting surface, and the second housing is formed with a spring arm locking with the locking slot to prevent the second housing from departing from the first housing along an assembling direction of the second housing, and a position projection engaging with the position slot to prevent the second housing from moving along a deformed direction of the spring arm.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 3 is an exploded view of the electrical connector shown in

FIG. 1;

DETAILED DESCRIPTION OF THE PREFERRED EMBODIMENTS

Figure 1:
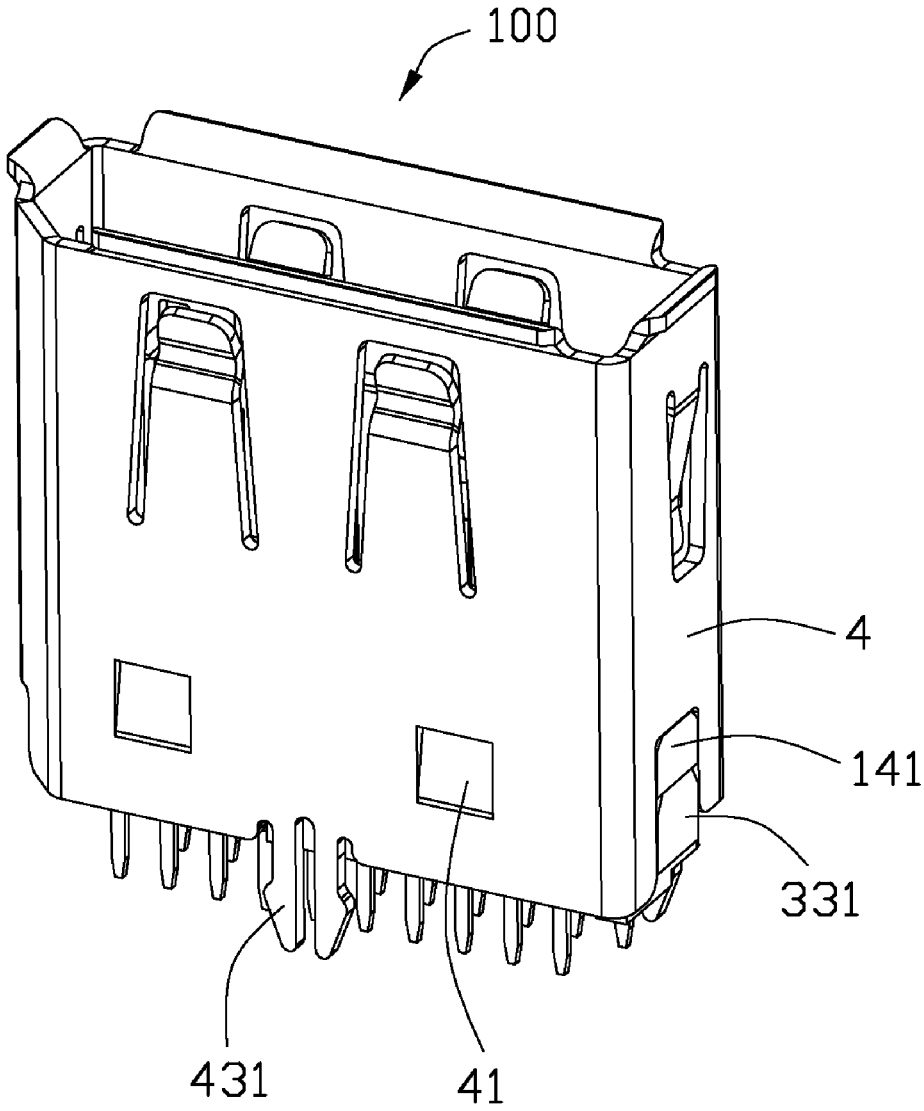
FIG. 1 is a perspective view of an electrical connector according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
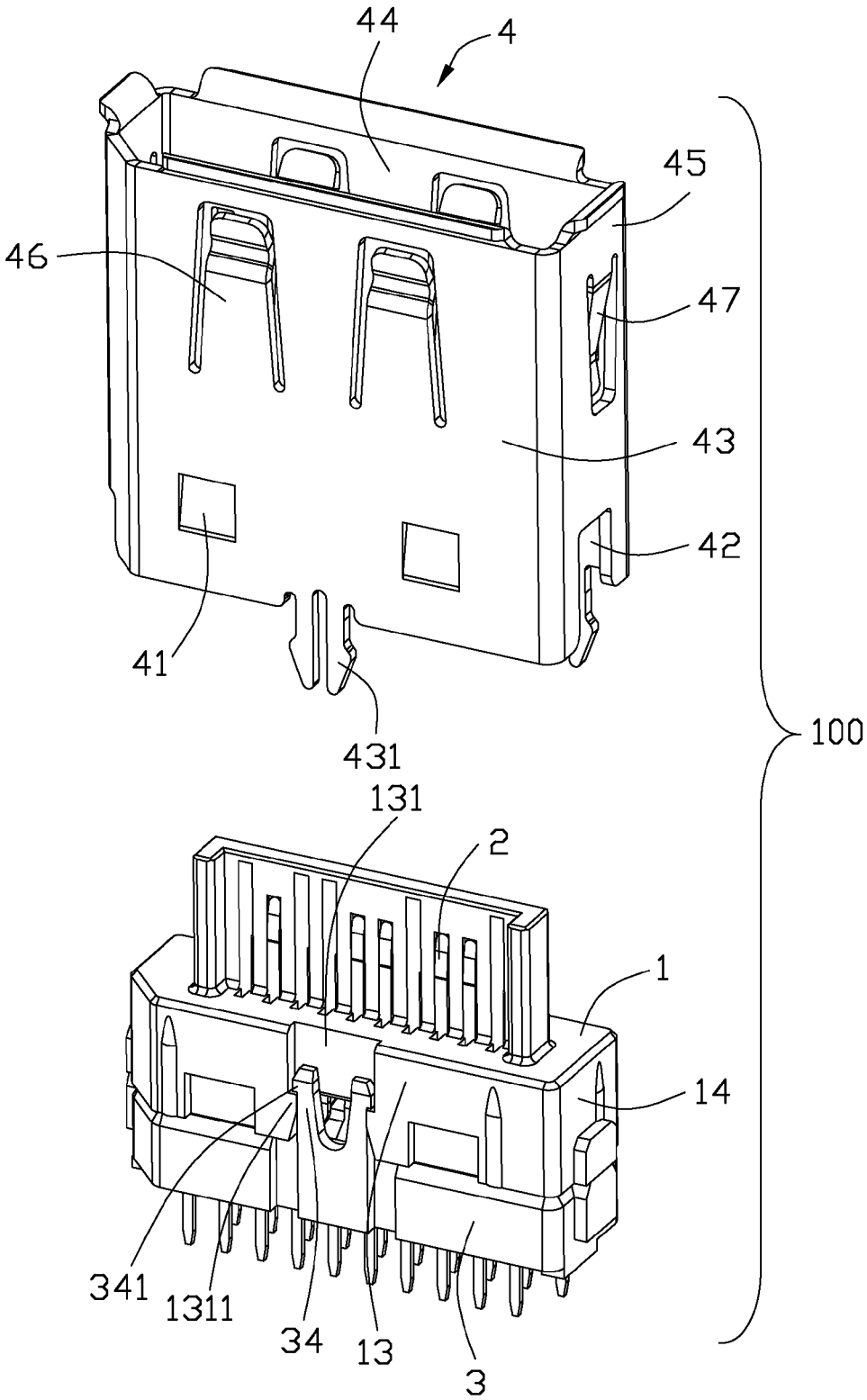
FIG. 2 is a partially exploded view of the electrical connector shown in FIG. 1.
Figure 3:
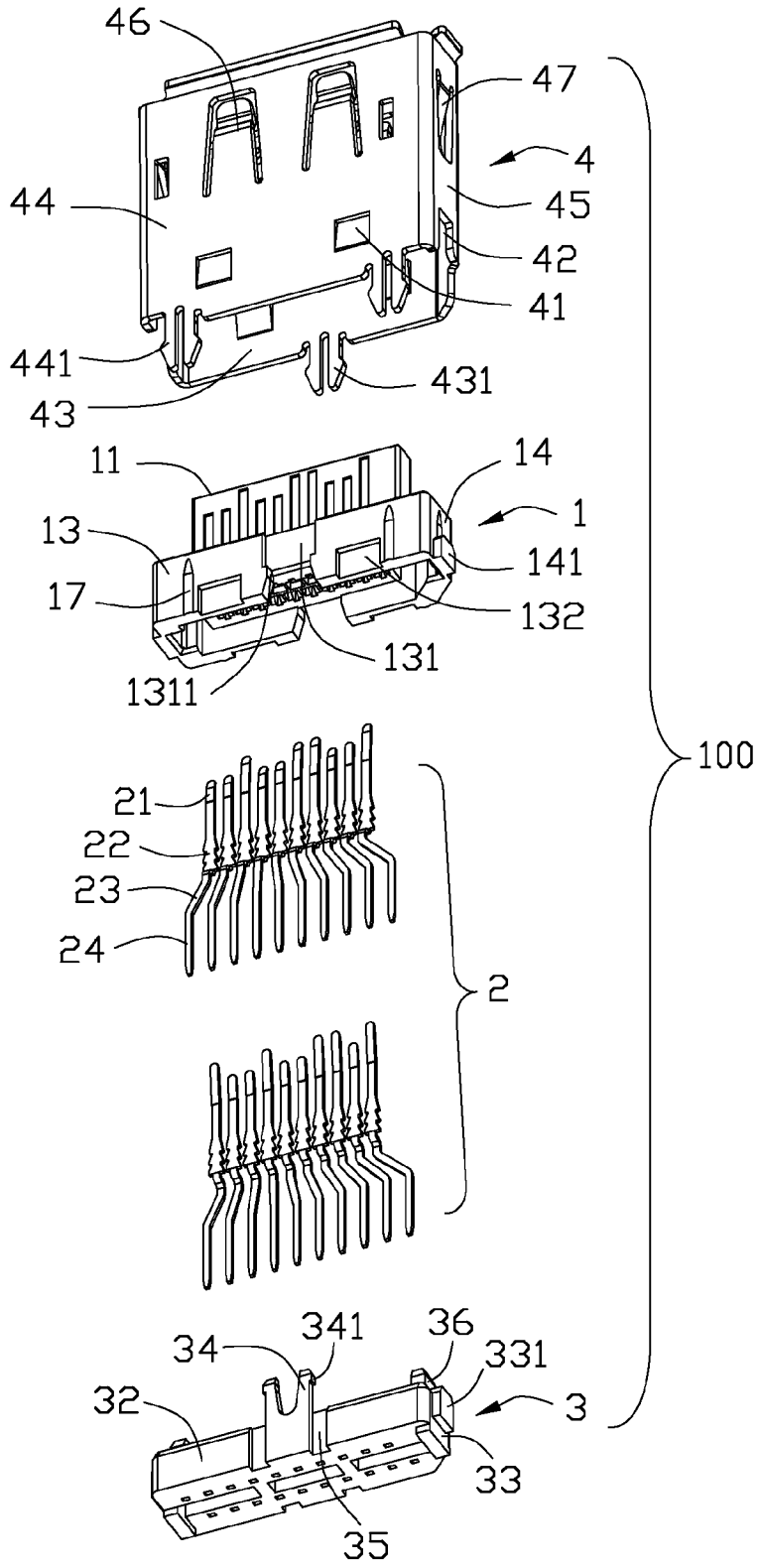

Referring to FIGS. 1-3, an electrical connector 100 for soldering to a circuit board according to the present invention comprises a first housing 1, a second housing 3 retained to a lower side of the first housing 1, a plurality of contacts 2 retained in the first and second housings 1, 3 and a metal shell 4 covering the first and second housings 1, 3.

Figure 4:
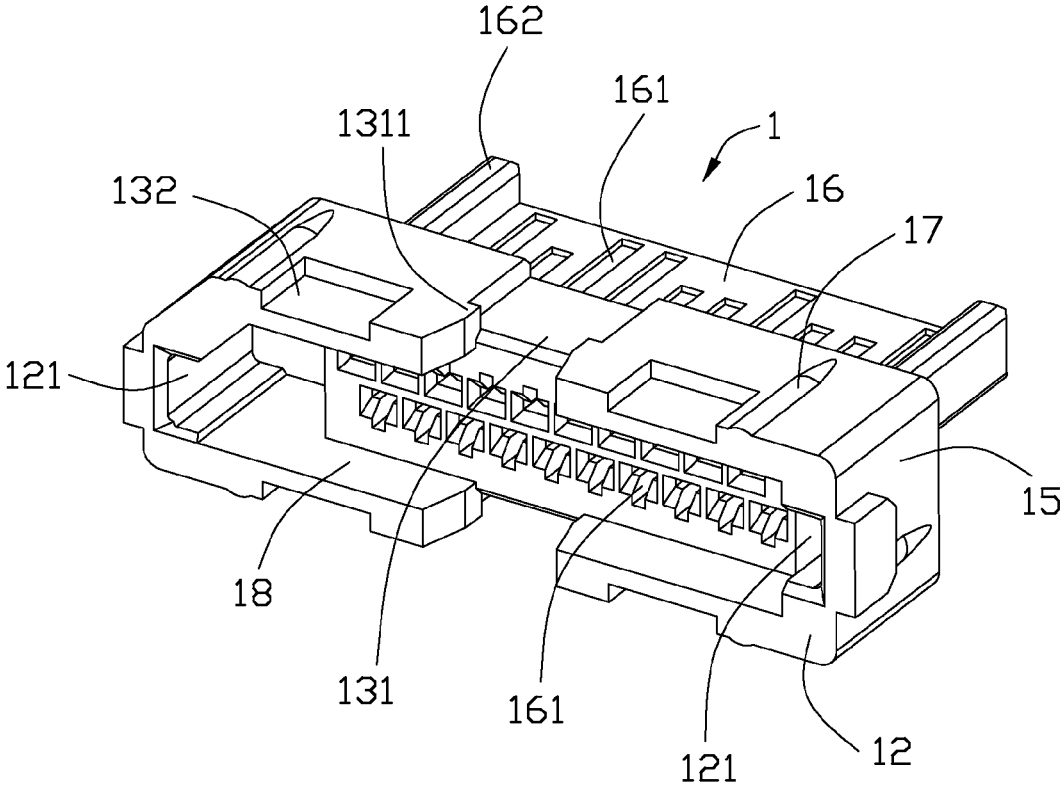
FIG. 4 is a perspective view of a first housing of the electrical connector shown in FIG. 3.
Figure 5:
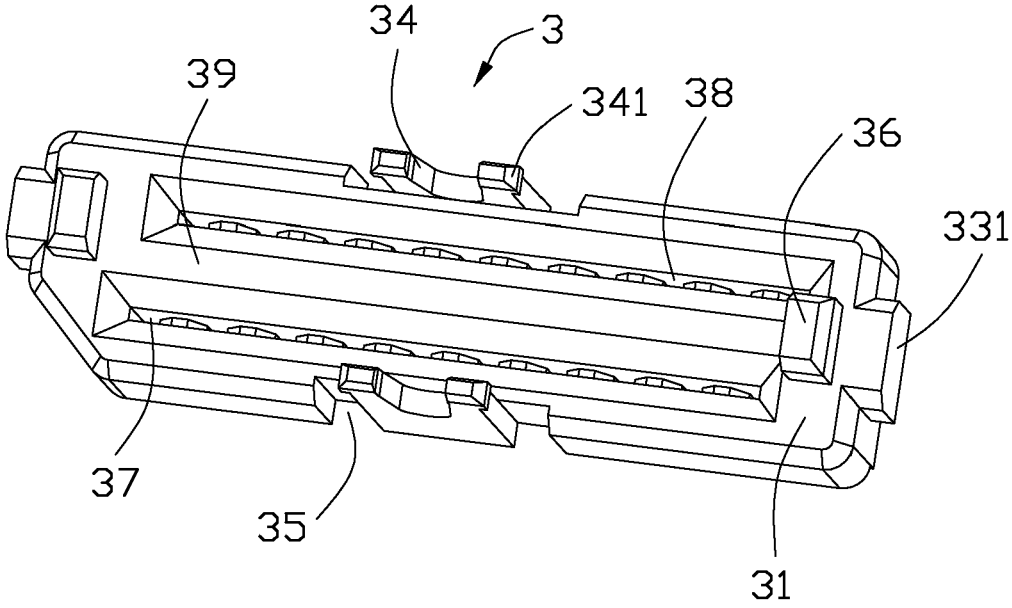
FIG. 5 is a perspective view of a second housing of the electrical connector shown in FIG. 3.

Referring to FIGS. 2 and 4, the first housing 1 has a mating surface 11 for mating with a mating connector (not shown) and a mounting surface 12 at opposite upper and lower ends thereof, and a plurality of side surfaces connecting the mating surface 11 and the mounting surface 12. The side surface comprises a pair of parallel first side surfaces 13 extending along a width direction of the first housing 1 and a pair of second side surfaces 14 perpendicular to the first side surfaces 13. The first housing 1 has a body portion 15 and a tongue 16 upwardly extending from a top end of the body portion 15. The tongue 16 defines a plurality of passageways 161 at two sides thereof, and a pair of projections 162 extending forwardly from two ends thereof for preventing the mating connector from being mis-mated. The passageways 161 extend along an up to down direction and extend through the body portion 15. The up to down direction is also an assembly direction of the second housing 3 to the first housing 1.

The body portion 15 is formed with a pair of locking slots 131 recessed upwardly from front and rear sides of the mounting surface 12 and two pairs of blocks 1311 projecting into the locking slots 131 from inner walls of the locking slots 131 respectively. The locking slots 131 outwardly extend through the first side surfaces 13 and upwardly extend through the body portion 15 for making a mold (not shown) which is used to form the blocks 131 easily move along the up to down direction. The body portion 15 further has a plurality of depressions 132 recessed from the first side surfaces 13 and a pair of first protrusions 141 outwardly extending from the second side surfaces 14. Besides, the body portion 15 defines a pair of position slots 121 upwardly recessed from two sides of the mounting surface 12. The position slots 121 are located at two sides of the passageways 161 along the width direction. The body portion 15 is formed with a plurality of ribs 17 protruding outwardly from the first and second side surfaces 13, 14 to engage with the metal shell 4. Besides, the first housing 1 defines a first receiving cavity 18 upwardly recessed from the mounting surface 12 between the side surfaces. The first receiving cavity 18 communicates with the passageways 161 along the up to down direction. The position slots 121 communicate with the first receiving cavity 18 along the width direction, and are recessed deeper than the first receiving cavity 18.

The contacts 2 are arranged in two rows which is respectively located at two sides of the tongue 16. Each contact 2 has a retaining portion 22 retained to the passageways 161 of the body portion 15, a contact portion 21 upwardly extending to the tongue 16 from one end of the body portion 15, a bending portion 23 outwardly and sidewardly extending from another end of the body portion 15, and a tail portion 24 downwardly extending from a lower end of the bending portion 23. The bending portions 23 are partly received in the first receiving cavity 18. The adjacent two tail portions 24 define a distance which is larger than that between adjacent two contact portions 21.

The second housing 3 is upwardly retained to a lower side of the first housing 1. The second housing 3 has a joint surface 31 to joint with the mounting surface 12 of the first housing 1, two first side walls 32 corresponding to the first side surfaces 13 along the up to down direction, and two second side walls 33 corresponding to the second side surfaces 14 along the up to down direction. The second housing 3 is formed with two pairs of spring arms 34 respectively extending upwardly from two first side walls 32. Each pair of spring arms 34 define a first distance between two outer sides thereof. Each locking slot 13 defines a second distance between opposed two inner walls thereof. The second distance is equal to or smaller than the first distance, then the spring arms 34 deform along the width direction in an assembly process of the second housing 3 and rebound to resist the inner walls of the locking slots 13. Thereby the spring arms 34 can tightly resist the inner walls of the locking slot 13 to stably fasten the second housing 3 to the first housing 1. The width direction is a deformed direction of the spring arms 34. Each spring arm 34 is formed with a hook 341 extending outwardly from a free end thereof to lock with the blocks 1311 in the locking slot 13. Each first side wall 32 defines a pair of hollows 35 below the hooks 341 to make a mold (not shown) which is used to form the hooks 341 easily move along the up to down direction. The second housing 3 further has a pair of position projections 36 upwardly extending out of the joint surface 31 from the second side walls 33 respectively to engage with the position slots 121.

In assembly, the position projections 36 can guide the second housing 3 to directly move upwardly and prevent the second housing 3 from moving along the width direction or a front to back direction. Besides, the second housing 3 has a pair of second protrusions 331 aligned with the first protrusions 141 along the up to down direction to engage with the metal shell 4. The second housing 3 defines a pair of second receiving cavities 37 extending along the width direction, and a plurality of through holes 38 extending therethrough along the up to down direction. The second receiving cavities 37 communicate with the through holes 38 and the first receiving cavities 18 along the up to down direction. The adjacent two through holes 38 define a distance which is larger than that of adjacent two passageways 161. The second housing 3 is formed with a partition board 39 between the receiving cavities 37 to prevent two rows of contacts 2 from contacting with each other. The bending portions 23 of the contacts 2 are received in the first and second receiving cavities 18, 37. The tail portions 24 are partly received in the through holes 38 and downwardly extend out of the second housing 3.

The metal shell 4 covers the first and second housings 1, 3 to form a receiving space between the metal shell 4 and the tongue 16 for receiving the mating connector. The locking slots 131 communicate with the receiving space along the up to down direction. The metal shell 4 has a pair of opposed front wall 43 and rear wall 44, and a pair of side walls 45 between the front and rear walls 43, 44. The front and rear walls 43, 44 respectively resist the first side surfaces 13 of the first housing 1 to sandwich the spring arms 34 between the metal shell 4 and the first housing 1 for preventing the spring arms 34 from moving along the front to back direction. The front and rear walls 43, 44 each defines a pair of locking tangs 41 extending inwardly and upwardly. The locking tangs 41 are located at a lower side of the front and rear walls 43, 44 to inwardly and upwardly resist the depressions 1 for preventing the first housing 1 from moving downwardly. Each side wall 45 defines an aperture 42 at a lower end thereof to receive the first and second protrusions 141, 331 for preventing the first and second housings 1, 3 from moving upwardly.

Besides, the front wall 43 is formed with a first mounting leg 431 downwardly extending from a middle lower end thereof, and the rear wall 44 is formed with a pair of second mounting legs 441 downwardly extending from a lower end thereof. The first mounting leg 431 is located between the second mounting legs 441 along the width direction, then the first and second mounting legs 431, 441 are arranged on three apexes of an isosceles triangle for stably fastening the electrical connector 100 in the present invention to the circuit board. The front and rear walls 43, 44 each has a pair of fastening strips 46 extending upwardly to lock with the mating connector. The side walls 45 each has a resisting strip 47 extending downwardly to resist the mating connector.

As fully described above, the second housing 3 is fastened to the first housing 1 via the locking slots 131 and spring arms 34 resisting to each other, and the blocks 1311 and hooks 341 locking with each other, thereby the second housing 3 can be tightly retained to the first housing 1 to make the electrical connector 100 has a stably structure. Besides, the spring arms 34 are flexible, then the spring arms 34 can move inwardly in an assembling process of the second housing 3 and rebounded to resist the inner walls of the locking slots 131; therefore, the spring arms 34 and blocks 1311 are easily manufactured and does not need a high precision. In addition, the second housing 3 is formed with the position projections 36 to engage with the position slots 121 of the first housing 1, which can guide the second housing 3 favorably retained to the first housing 1 to improve an assembly efficiency and prevent the second housing 3 from moving along the width direction.

In the present invention, the locking slots 131 of the first housing 1 align to each other along the front to back direction, and the spring arms 33 also align to each other corresponding the locking slots 131. Of course, the locking slots 131 can be alternatively designed to stagger with each other along the front to back direction, and the spring arms 33 stagger with each other along the front to back direction corresponding the staggered locking slots 131. Besides, all locking slots 131 are arranged on the first housing 1, and all spring arms 33 are arranged on the second housing 3. Of course, the locking slots 131 can be alternatively arranged at the first and second housings 1, 3 respectively, and the spring arms 33 are arranged to the first and second housings 1, 3 corresponding the locking slots 131, which also can stably fasten the second housing to the first housing and has a low manufacture precision.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

a first housing having a mating surface and a mounting surface at two sides thereof; and a second housing having a joint surface to joint with the mounting surface; wherein the first housing defines a locking slot recessed from the mounting surface, and the second housing is formed with a pair of spring arms extending out of the joint surface to resist opposed two inner walls of the locking slot; and a plurality of contacts retained to the first housing, the first housing has a body portion and a tongue upwardly extending from the body portion and position slots, and the tongue defines a plurality of passageways at two sides thereof and extending through the body portion to retain the contacts, the position slots are located at two outer sides of the passageways, and the locking slot upwardly extends through the body portion, wherein the second housing defines a receiving cavity extending along a width direction thereof and a plurality of through holes extending therethrough and communicating with the receiving cavity, wherein the adjacent two through holes define a distance which is larger than that of adjacent two passageways, and each contact has a retaining portion retained in the body portion, a contact portion extending to the tongue from one end of the retaining portion, a bending portion obliquely extending from another end of the retaining portion to be received in the receiving cavity, and a tail portion extending through the through holes, the adjacent tail portions define a distance which is larger than that between adjacent contact portions.

2. The electrical connector as claimed in claim 1, wherein the first housing has a pair of blocks projecting into the locking slot from the inner walls respectively, and each spring arm has a hook extending outwardly to lock with the blocks.

3. The electrical connector as claimed in claim 2, wherein the first housing has a pair of first side surfaces extending along a width direction thereof, a pair of second side surfaces perpendicular to the first side surfaces, and two said locking slots respectively extending through two first side surfaces, and the second housing has two pairs of said spring arms extending from the joint surface to respectively lock with the locking slots.

4. The electrical connector as claimed in claim 3, further comprising a metal shell covering the first housing, the metal shell comprises a front wall and a rear wall respectively resisting the first side surfaces to sandwich the spring arms between the metal shell and the first housing.

5. The electrical connector as claimed in claim 2, wherein the second housing defines a plurality of hollows below the hooks, and the hollows extend through the second housing along an up to down direction.

6. The electrical connector as claimed in claim 1, wherein each pair of spring arms defines a first distance between two outer sides thereof, and each locking slot defines a second distance which is equal to or smaller than the first distance.

7. The electrical connector as claimed in claim 1, wherein the first housing further defines a pair of position slots recessed from two sides of the mounting surface, and the second housing is formed with a pair of position projections to engage with the position slots.

8. The electrical connector as claimed in claim 1, further comprising a metal shell covering the first and second housing, the first housing is formed with a plurality of depressions recessed from the first side surfaces and a pair of protrusions extending outwardly from the second side surfaces, and the metal shell has a plurality of locking tangs extending inwardly and upwardly to resist the depressions for preventing the first housing form moving downwardly, and a pair of apertures at two sides thereof to lock with the protrusions for preventing the first housing from moving upwardly.

9. The electrical connector as claimed in claim 8, wherein the metal shell has a front wall, a rear wall and a pair of side walls, and the front wall is formed with a first mounting leg extending downwardly, and the rear wall is formed with a pair of second mounting legs extending downwardly and located at two sides of the first mounting leg along a width direction of the first housing.

10. An electrical connector, comprising:

a first housing having a mating surface and a mounting surface at two sides thereof;

a second housing retained to the first housing and having a joint surface to joint with the mounting surface; wherein the first housing defines a locking slot and a position slot respectively recessed from the mounting surface, and the second housing is formed with a spring arm locking with the locking slot to prevent the second housing from departing from the first housing along an assembling direction of the second housing, and a position projection engaging with the position slot to prevent the second housing from moving along a deformed direction of the spring arm; and a plurality of contacts retained to the first housing, the first housing has a body portion and a tongue upwardly extending from the body portion, and the tongue defines a plurality of passageways at two sides thereof and extending through the body portion to retain the contacts, the position slots are located at two outer sides of the passageways, and the locking slot upwardly extends through the body portion, wherein the second housing defines a receiving cavity extending along a width direction thereof and a plurality of through holes extending therethrough and communicating with the receiving cavity, wherein the adjacent two through holes define a distance which is larger than that of adjacent two passageways, and each contact has a retaining portion retained in the body portion, a contact portion extending to the tongue from one end of the retaining portion, a bending portion obliquely extending from another end of the retaining portion to be received in the receiving cavity, and a tail portion extending through the through holes, the adjacent tail portions define a distance which is larger than that between adjacent contact portions.

11. The electrical connector as claimed in claim 10, wherein the spring arm and position projection extend out of the joint surface, and the first housing has a pair of blocks projecting into the locking slot from opposed two inner walls of the locking slot, and the second housing is formed with a pair of said spring arms, and each spring arm has a hook extending outwardly to respectively lock with the blocks in the locking slot.

12. The electrical connector as claimed in claim 11, wherein the pair of spring arms defines a first distance between two outer sides thereof, and each locking slot defines a second distance which is equal to or smaller than the first distance.

13. The electrical connector as claimed in claim 12, wherein the second housing defines a plurality of hollows below the hooks, and the hollows extend through the second housing along the assembling direction.

14. An electrical connector comprising:

a first insulative housing defining a mating port; a second insulative housing defining a mounting port opposite to the mating port in a downward direction;

a plurality of contacts each assembled to both said first insulative housing and said second insulative housing under condition that each of said contacts includes a mating section exposed on the mating port and a mounting section exposed on the mounting port; and a metallic shell essentially fully enclosing both said first insulative housing and said second insulative housing therein; wherein said shell is assembled and secured to the first insulative housing in said downward direction while said second insulative housing is assembled and secured to the first insulative housing in an upward direction opposite to said downward direction; wherein each of said first insulative housing and said second insulative housing define a protrusion, under condition that the protrusion of the insulative first housing is aligned with the protrusion of the second insulative housing in the upward direction, and said shell defines a downward long slot to receive both said protrusions, wherein the first housing defines a locking slot recessed from the mounting surface and a pair of blocks projecting into the locking slot from the inner walls respectively and the second housing is formed with a pair of spring arms, and each spring arm has a hook extending outwardly to lock with the blocks, and said locking slots and spring arms are formed on long sides of both said first insulative housing and said second insulative housing while said protrusions are formed on short sides of said first insulative housing and said second insulative housing, wherein the shell includes a front wall, a rear wall and a pair of side walls, and the front wall is formed with a first mounting leg extending downwardly, and the rear wall is formed with a pair of second mounting legs extending downwardly and located at two sides of the first mounting leg along a width direction of the first housing, wherein the mounting legs have downward hooks for locking to a printed circuit board on which the second insulative housing is seated while the spring arms of the second insulative housing have upward hooks for latching to the first insulative housing.

* * * * *